US006286298B1

(12) United States Patent
Burrus et al.

(10) Patent No.: US 6,286,298 B1
(45) Date of Patent: Sep. 11, 2001

(54) APPARATUS AND METHOD FOR RICH-QUENCH-LEAN (RQL) CONCEPT IN A GAS TURBINE ENGINE COMBUSTOR HAVING TRAPPED VORTEX CAVITY

(75) Inventors: David L. Burrus; Arthur W. Johnson, both of Cincinnati; Hukam C. Mongia, West Chester, all of OH (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/215,861

(22) Filed: Dec. 18, 1998

(51) Int. Cl.[7] ..... F02C 7/08; F02C 3/14; F23R 3/12; F23R 3/58

(52) U.S. Cl. ..... 60/39.06; 60/737; 60/732; 60/750; 60/751

(58) Field of Search ..... 60/737, 732, 749, 60/750, 751, 39.06

(56) References Cited

U.S. PATENT DOCUMENTS

| | | | | |
|---|---|---|---|---|
| 2,999,359 | * | 9/1961 | Murray | 60/737 |
| 3,034,297 | * | 5/1962 | Orchard | 60/749 |
| 3,299,632 | * | 1/1967 | Wilde | 60/751 |
| 3,620,012 | * | 11/1971 | Wilde | 60/749 |
| 3,675,419 | * | 7/1972 | Lewis | 60/39.36 |
| 3,973,390 | * | 8/1976 | Jeroszko | 60/737 |
| 4,455,839 | * | 6/1984 | Wuchter | 60/737 |
| 4,455,840 | * | 6/1984 | Matt et al. | 60/737 |
| 4,563,875 | * | 1/1986 | Howald | 60/737 |
| 5,207,064 | * | 5/1993 | Ciokajlo et al. | 60/737 |
| 5,335,490 | * | 8/1994 | Johnson et al. | 60/749 |
| 5,619,855 | | 4/1997 | Burrus | 60/736 |
| 5,657,632 | * | 8/1997 | Foss | 60/742 |
| 5,791,148 | | 8/1998 | Burrus | 60/752 |
| 5,802,854 | * | 9/1998 | Maeda et al. | 60/737 |
| 5,813,232 | * | 9/1998 | Razdan et al. | 60/737 |
| 5,885,068 | * | 3/1999 | Dobbeling et al. | 60/737 |
| 6,047,550 | * | 4/2000 | Beebe | 60/737 |

* cited by examiner

*Primary Examiner*—Ted Kim
(74) *Attorney, Agent, or Firm*—Andrew C. Hess; William Scott Andes

(57) ABSTRACT

A fuel injection system for a gas turbine engine combustor, wherein the combustor includes a dome inlet module having a plurality of flow passages formed therein and at least one cavity formed in a liner downstream of said dome inlet module. The fuel injection system includes a fuel supply and a plurality of fuel injector bars positioned circumferentially around and interfacing with the inlet dome module. The fuel injector bars are in flow communication with the fuel supply, with each of the fuel injector bars further including a body portion having an upstream end, a downstream end, and a pair of sides. At least one injector is formed in the downstream end of the body portion and in flow communication with the fuel supply, whereby fuel is provided to the cavity through the fuel injector bars in accordance with a Rich-Quench-Lean (RQL) process. Consistent with such RQL process, fresh air is provided through flow passages of the dome inlet module directly into the combustion chamber to maximize the distance available for effecting good mixing and rapid dilution of the combustion gases to a lean state.

14 Claims, 3 Drawing Sheets

APPARATUS AND METHOD FOR RICH-QUENCH-LEAN (RQL) CONCEPT IN A GAS TURBINE ENGINE COMBUSTOR HAVING TRAPPED VORTEX CAVITY

BACKGROUND OF THE INVENTION

1. Field of the Invention

The present invention relates to a gas turbine engine combustor having at least one trapped vortex cavity and, more particularly, to an apparatus and method for injecting fuel into such cavity and providing high inlet air flows to the combustion chamber through flow passages of a dome inlet module in accordance with a Rich-Quench-Lean (RQL) process.

2. Description of Related Art

Advanced aircraft gas turbine engine technology requirements are driving the combustors therein to be shorter in length, have higher performance levels over wider operating ranges, and produce lower exhaust pollutant emission levels. One example of a combustor designed to achieve these objectives is disclosed in U.S. Pat. No. 5,619,855 to Burrus. As seen therein, the Burrus combustor is also to operate efficiently at inlet air flows having a high subsonic Mach Number. This stems in part from a dome inlet module which allows air to flow freely from an upstream compressor to the combustion chamber, with fuel being injected into the flow passage. The combustor also has inner and outer liners attached to the dome inlet module which include upstream cavity portions for creating a trapped vortex of fuel and air therein, as well as downstream portions extending to the turbine nozzle.

It will be noted in the aforementioned Burrus combustor that the fuel is injected into the trapped vortex cavities through a portion of the liner forming an aft wall of such cavity. Fuel is also injected into the flow passages of the dome inlet module via atomizers located along hollow vanes of the dome inlet module, the vanes being in flow communication with a fuel manifold. While functional for its intended purpose, it has been found that the fuel injection approach taken in the '855 patent lacks simplicity. In particular, it will be understood that this design requires the occupation of significant space within the combustor housing cavity, as separate systems are utilized for injecting the fuel into the cavities and the dome inlet module. This not only represents a large cost from a manufacturing standpoint, but extraction of fuel injectors from the engine for repair or replacement with a major tear down of the engine to expose the combustor cavity section is not permitted.

In order to address the concerns associated with the '855 combustor, a new design employing a plurality of circumferentially spaced fuel injector bars are located upstream of a modified dome inlet module is shown and disclosed in a patent application Ser. No. 09/215,863 entitled "Fuel Injector Bar For A Gas Turbine Engine Combustor Having Trapped Vortex Cavity," which is also owned by the assignee of the present invention, hereby incorporated by reference, and filed concurrently herewith. It will be appreciated that the combustor of this concurrently filed patent application utilizes the fuel injector bars to inject fuel into the cavities in the liner, as well as the flow passages of the dome inlet module in a dual stage process.

Another method for achieving low emissions within combustor designs is a concept known as Rich-Quench-Lean (RQL). This concept features a very rich primary combustion zone with local equivalence ratios typically much greater than 1.0, which allows initiation of the mixing of the fuel with some of the combustor air and provides combustion under oxygen deprived conditions. Accordingly, formation of nitrous oxide (NOx) in the primary zone is reduced. The partially burned combustion gases from the rich primary zone then undergo a rapid dilution from the injection of significant amounts of additional fresh combustor air. The difficulty is in achieving a rapid mixing of the fresh air with the rich primary zone combustion gases to drive the overall mixture quickly to a lean state (i.e., an equivalence ratio well below 1.0). This prevents NOx formation in the dilution zone by not allowing the combustion gases sufficient time at local equivalence ratios between 0.85 and 1.15 where rapid NOx formation occurs. While RQL combustors have a significant advantage over other low emissions concepts in the area of combustion dynamics, it is known that low emissions, good combustion efficiency, and good exit gas temperature profile and pattern are difficult to achieve in the RQL concept.

Accordingly, it would be desirable for a combustor design to be developed which is compatible with use of the RQL concept. It would also be desirable for a fuel injection system to be developed in a gas turbine engine combustor having a liner with one or more trapped vortex cavities so that the RQL concept can be utilized therewith.

SUMMARY OF THE INVENTION

In accordance with one aspect of the present invention, a fuel injection system for a gas turbine engine combustor is disclosed, wherein the combustor includes a dome inlet module having a plurality of flow passages formed therein and at least one cavity formed in a linear downstream of said dome inlet module. The fuel injection system includes a fuel supply and a plurality of fuel injector bars positioned circumferentially around and interfacing with the inlet dome module. The fuel injector bars are in flow communication with the fuel supply, with each of the fuel injector bars further including a body portion having an upstream end, a downstream end, and a pair of sides. At least one injector is formed in the downstream end of the body portion and in flow communication with the fuel supply, whereby fuel is provided to the cavities through the fuel injector bars.

In accordance with a second aspect of the present invention a method of operating a gas turbine combustor is disclosed, where the combustor includes a dome inlet module having a plurality of flow passages formed therein and at least one cavity formed within a combustion chamber by a liner downstream of the dome inlet module. The method includes the step of injecting fuel into an upstream end of the cavity so as to create a rich primary combustion zone therein, injecting air into the cavity to create a trapped vortex of fuel and air therein, igniting the mixture of fuel and air in the cavity to form combustion gases, diluting the combustion gases with a flow of air through the flow passages of the dome inlet module, and driving the overall mixture of fuel and air within the combustion chamber to a lean state.

BRIEF DESCRIPTION OF THE DRAWING

While the specification concludes with claims particularly pointing out and distinctly claiming the present invention, it is believed that the same will be better understood from the following description taken in conjunction with the accompanying drawing in which:

DETAILED DESCRIPTION OF THE INVENTION

Figure 1:
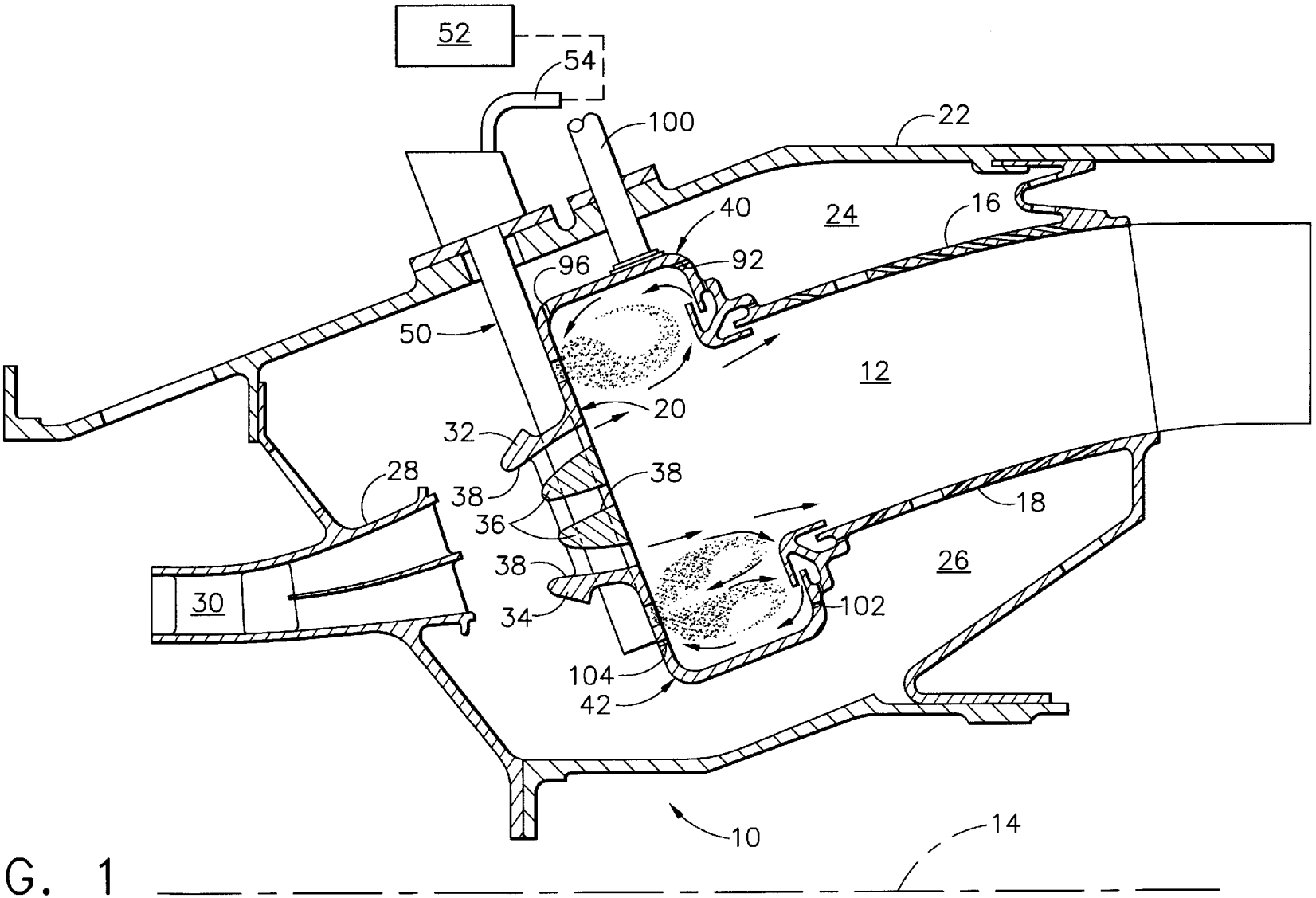
FIG. 1 is a longitudinal cross-sectional view of a gas turbine engine combustor having a fuel injection system in accordance with the present invention.

Referring now to the drawing in detail, wherein identical numerals indicate the same elements throughout the figures, FIG. 1 depicts a combustor 10 which comprises a hollow body defining a combustion chamber 12 therein. Combustor 10 is generally annular in form about an axis 14 and is further comprised of an outer liner 16, an inner liner 18, and a dome inlet module designated generally by the numeral 20. A casing 22 is preferably positioned around combustor 10 so that an outer radial passage 24 is formed between casing 22 and outer liner 16 and an inner passage 26 is defined between casing 22 and inner liner 18.

It will be appreciated that dome inlet module 20 may be like that shown and disclosed in U.S. Pat. No. 5,619,855 to Burrus, which is also owned by the assignee of the current invention and is hereby incorporated by reference. Instead, FIG. 1 depicts combustor 10 as having a dome inlet module 20 like that shown and disclosed in the '863 patent application, where it is separate from a diffuser 28 located upstream thereof for directing air flow from an exit end 30 of a compressor. Dome inlet module 20 preferably includes an outer vane 32 connected to outer liner 16 and extending axially upstream, an inner vane 34 connected to inner liner 18 and extending axially upstream, and one or more vanes 36 disposed therebetween so as to form a plurality of flow passages 38 (while three such flow passages are shown in FIG. 1, there may be either more or less depending upon the number of vanes 36 provided). Preferably, dome inlet module 20 is positioned in substantial alignment with the outlet of diffuser 28 so that the air flow is directed unimpeded into combustion chamber 12.

It will be noted that achieving and sustaining combustion in such a high velocity flows is difficult and likewise carries downstream into combustion chamber 12 as well. In order to overcome this problem within combustion chamber 12, some means for igniting the fuel/air mixture and stabilizing the flame thereof is required. Preferably, this is accomplished by the incorporation of a trapped vortex cavity depicted generally by the number 40, formed at least in outer liner 16. A similar trapped vortex cavity 42 is preferably provided in inner liner 18 as well. Cavities 40 and 42 are utilized to provide a trapped vortex of fuel and air, as discussed in the aforementioned '855 patent and depicted schematically in cavity 42 of FIG. 1.

With respect to outer and inner liners 16 and 18, trapped vortex cavities 40 and 42 are incorporated immediately downstream of dome inlet module 20 and shown as being substantially rectangular in shape (although cavities 40 and 42 may be configured as arcuate in cross-section). Cavity 40 is open to combustion chamber 12 so that it is formed by an aft wall 44, a forward wall 46, and an outer wall 48 formed therebetween which preferably is substantially parallel to outer liner 16. Likewise, cavity 42 is open to combustion chamber 12 so that it is formed by an aft wall 45, a forward wall 47, and an inner wall 49 formed therebetween which preferably is substantially parallel to inner liner 18. Instead of injecting fuel into trapped vortex cavities 40 and 42 through a fuel injector centered within a passage in aft walls 44 and 45, respectively, as shown in U.S. Pat. No. 5,619,855, it is preferred that the fuel be injected through forward walls 46 and 47 by means of a plurality of fuel injector bars 50 positioned circumferentially around and interfacing with dome inlet module 20.

Figure 4:
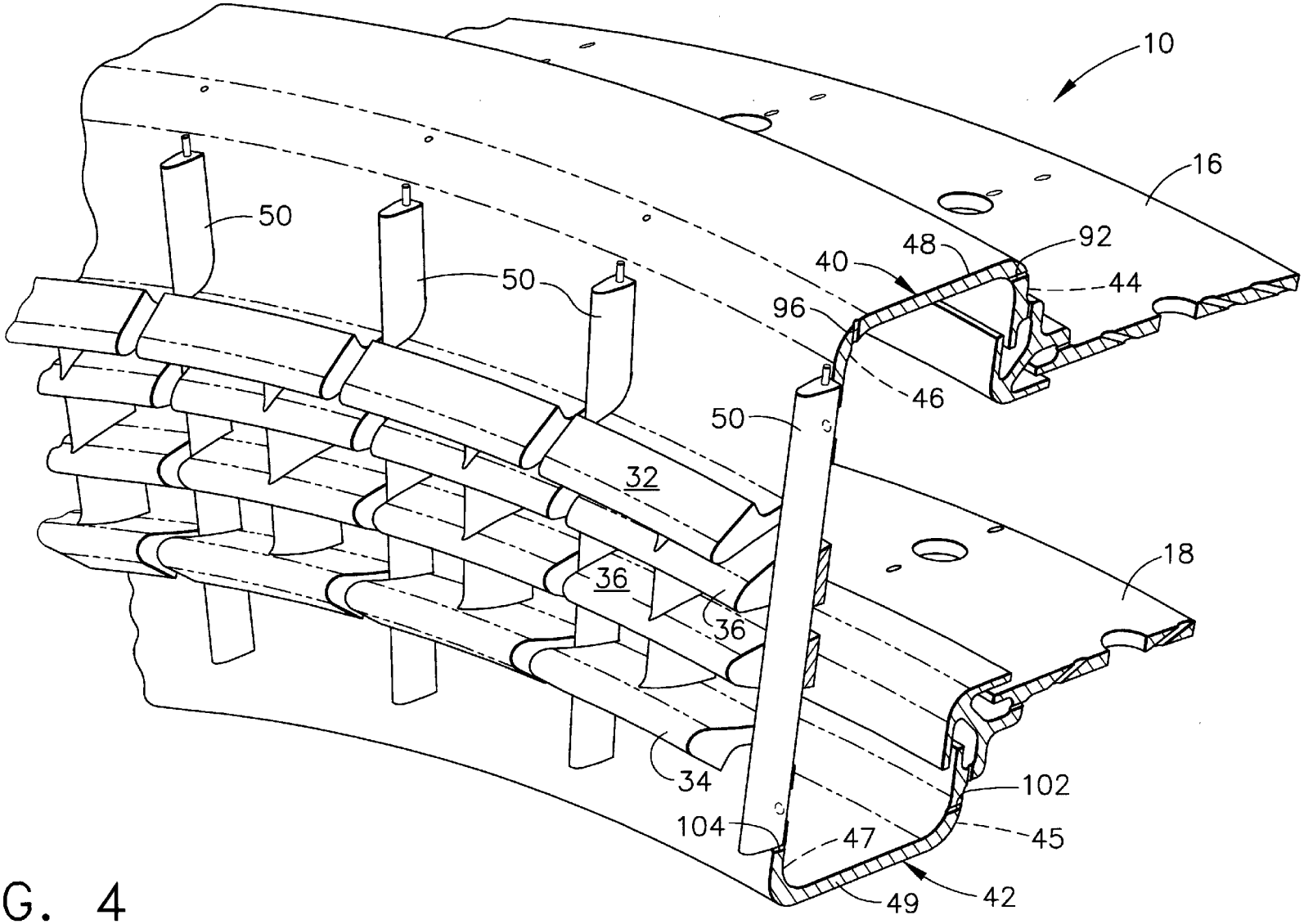
FIG. 4 is a forward perspective view of the dome inlet module depicted in FIG. 1, where the fuel injector bars are shown as interfacing therewith.

More specifically, fuel injector bars 50 are configured to be inserted into dome inlet module 20 through engine casing 22 around combustor 10. Depending upon the design of dome inlet module 20, each fuel injector bar 50 is then inserted into slots provided in vanes 32, 34 and 36 (see FIG. 4) or integrally therewith through openings provided therein. Fuel injector bars 50 are then in flow communication with a fuel supply 52 via fuel line 54 in order to inject fuel into cavities 40 and 42.

Figure 2:
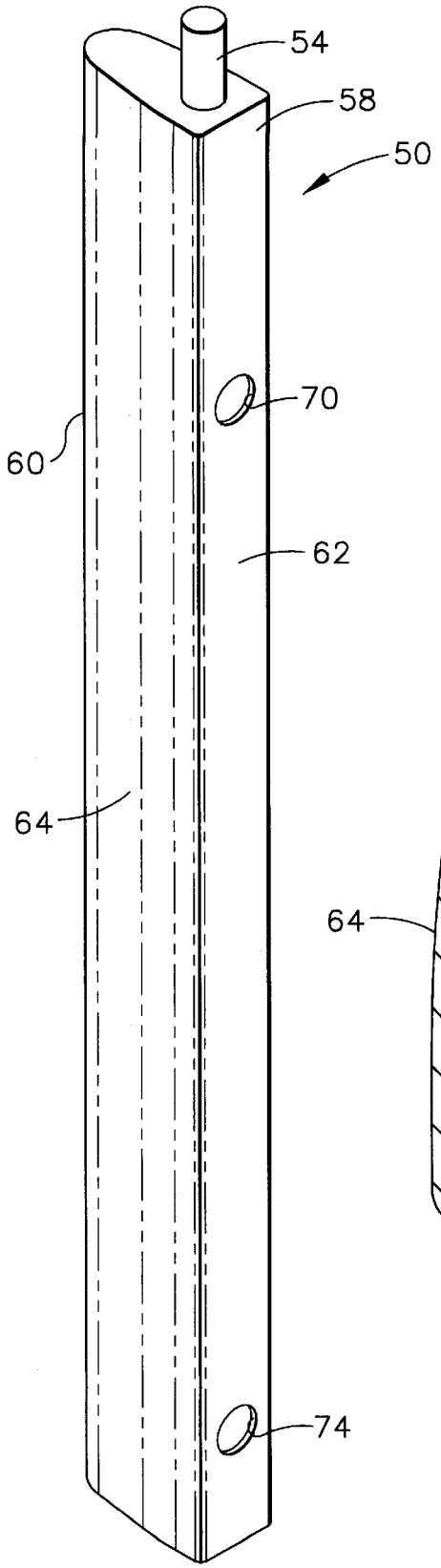
FIG. 2 is an aft perspective view of a single fuel injector bar.
Figure 3:
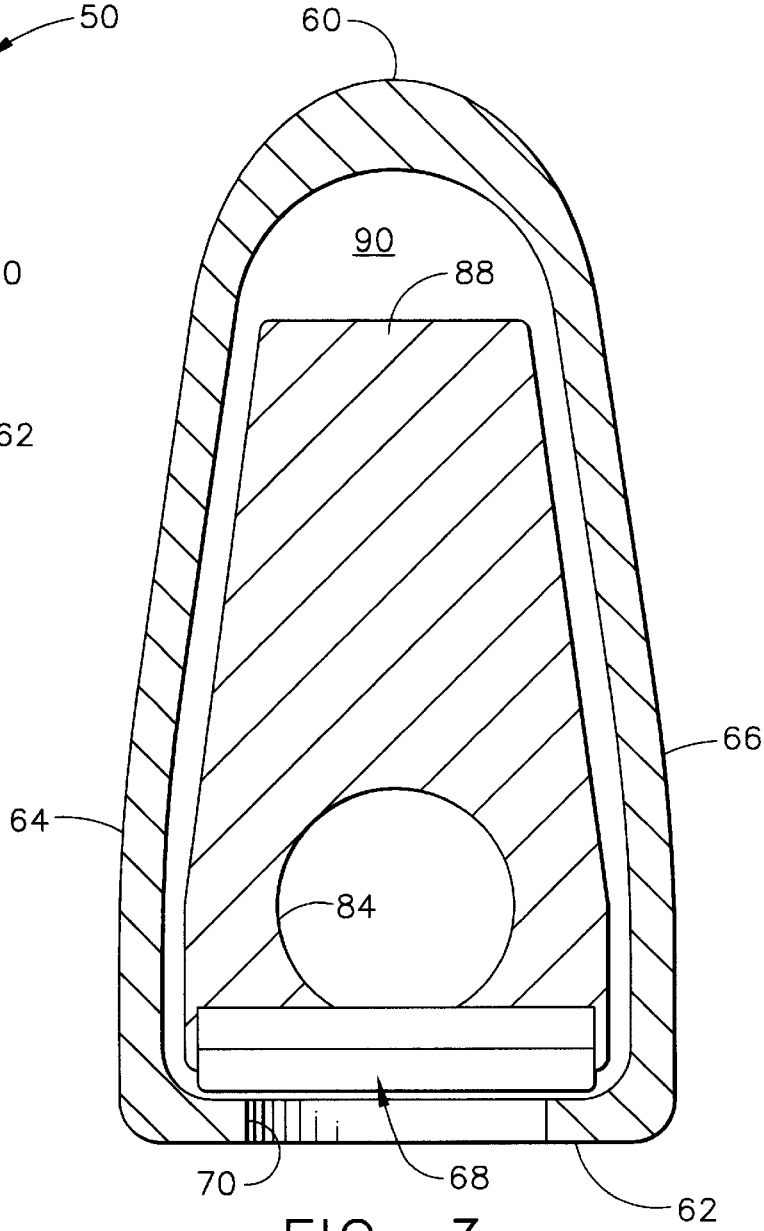
FIG. 3 is a top-cross sectional view of the fuel injector bar depicted in FIG. 2, whereby flow communication with the aft injectors is shown.

As seen in FIG. 2, each fuel injector bar 50 has a body portion 58 having an upstream end 60, a downstream end 62, and a pair of sides 64 and 66 (see FIG. 3). It will be noted that upstream end 60 is preferably aerodynamically shaped while downstream end 62 has, but is not limited to, a bluff surface. In order to inject fuel into cavities 40 and 42, a first injector 68 is positioned within an opening 70 located at an upper location of downstream end 62 and a second injector 72 is positioned within an opening 74 located at a lower location of downstream end 62. Contrary to the concurrently filed patent application having Ser. No. 09/215,863, where a pair of oppositely disposed openings 76 and 78 are provided in sides 64 and 66, respectively, for injectors 80 and 82 to inject fuel within each flow passage 38 of dome inlet module 20, the present invention does not include such side injectors since fuel is not injected into flow passages 38.

It will be appreciated from FIG. 3 that body portion 58 operates as a heat shield to the fuel flowing through a passage 84 to injectors 68 and 72, passage 84 being in flow communication with fuel line 54. Fuel line 54 is preferably brazed to passage 84 so as to provide flow communication and direct fuel to injectors 68 and 72. It will be understood that injectors 68 and 72 are well known in the art and may be atomizers or other similar means used for fuel injection.

Although a simple tube could be utilized to carry fuel from fuel line 54 to injectors 68 and 72, it is preferred that a middle portion 88 be housed within body portion 58 of fuel injector bars 50 with passage 84 being formed therein. Middle portion 88 is optimally made of ceramic or a similarly insulating material to minimize the heat transferred to the fuel. An additional air gap 90 may also be provided about middle portion 88 where available in order to further insulate the fuel flowing therethrough. It will be appreciated that middle portion 88 is maintained in position within body portion 58 by at least the attachment of fuel line 54 at an upper end thereof.

In operation, combustor 10 utilizes the regions within cavities 40 and 42 as the primary combustion zones, with fuel only being provided through injectors 68 and 72 of fuel injector bars 50. Air is injected into cavities 40 and 42 (as seen in FIG. 1 with respect to cavity 40) via passage 92 located at the intersection of aft wall 44 with outer wall 48, as well as passage 96 located adjacent the intersection of forward wall 46 with outer vane 36. In this way, a trapped vortex of fuel and air is created in cavities 40 and 42. While a single vortex of fuel and air is typically created within cavities 40 and 42, it will also be appreciated from cavity 42 in FIG. 1 that a double vortex can be established by positioning an air passage 102 midway along aft wall 45 (instead of at the intersection of aft walls 44/45 and outer/ inner walls 48/49) and an air passage 104 at the intersection of forward wall 47 and inner wall 49 (instead of adjacent an intersection of forward walls 46/47 and outer vane/inner vane 32/34 of dome inlet module 20). Thereafter, the mixture of fuel and air within cavities 40 and 42 are ignited, such as by igniter 100, to form combustion gases therein. These combustion gases then exhaust from cavities 40 and 42 across a downstream end of dome inlet module 20.

It will be appreciated that the primary combustion zones within cavities 40 and 42 are very rich (equivalence ratio greater than 1.0 and preferably within a range of approximately 1.0 to 2.0). Consistent with the RQL process, the diluting fresh air is provided through flow passages 38 of dome inlet module 20 directly into combustion chamber 12. This approach maximizes the distance available to effect good mixing and performance, especially when contrasted with providing the dilution air through an array of holes downstream in the liner as in past designs. Accordingly, using trapped vortex cavities in a combustor in combination with the RQL concept has encouraging test results when compared with the '863 patent application. By eliminating the side injectors of this concurrently filed design, system costs can be decreased and reliability increased.

Having shown and described the preferred embodiment of the present invention, further adaptations of the fuel injection system and the individual fuel injector bars can be accomplished by appropriate modifications by one of ordinary skill in the art without departing from the scope of the invention. In particular, it will be noted that the steps of the RQL process of the present invention can be implemented with combustors having other air and fuel injection schemes, so long as a trapped vortex of fuel and air is generated within at least one cavity and the air/fuel provided is in the appropriate relation.

What is claimed is:

1. A fuel injection system for a gas turbine engine combustor, said combustor including a dome inlet module having a plurality of flow passages formed therein by a plurality of vanes positioned circumferentially therein, a combustion chamber, and at least one trapped vortex cavity formed in a liner downstream of said dome inlet module by an aft wall, a forward wall, and a third wall therebetween, said fuel injection system comprising:

(a) a fuel supply;

(b) a plurality of radially disposed fuel injector bars positioned circumferentially around and interfacing with said inlet dome module, said fuel injector bars being in flow communication with said fuel supply, each of said fuel injector bars further comprising (1) a body portion having an upstream end, a downstream end, and a pair of sides; and (2) at least one injector formed in the downstream end of said body portion and in flow communication with said fuel supply and said forward wall of said trapped vortex cavity;

wherein fuel is provided to said trapped vortex cavity through said fuel injector bars.

2. The fuel injection system of claim 1, said body portion of said fuel injector bars being aerodynamically shaped at said upstream end.

3. The fuel injection system of claim 1, said body portion of said fuel injector bars having a bluff surface at said downstream end.

4. The fuel injection system of claim 1, said fuel injector bars being located integrally within said dome inlet module.

5. The fuel injection system of claim 1, said fuel injector bars being located in openings provided in said vanes of said dome inlet module.

6. The fuel injection system of claim 1, wherein said fuel injector bars are inserted into said dome inlet module through and connected to an engine casing surrounding said combustor.

7. The fuel injection system of claim 1, further comprising a fuel line in flow communication with said fuel supply and said injectors housed within said body portion of said fuel injector bars, wherein fuel flowing through said fuel line to said injectors is thermally protected.

8. The fuel injection system of claim 1, said fuel injector bars further comprising a middle portion housed within said body portion, said middle portion having a passage formed therein in flow communication with said fuel supply.

9. The fuel injection system of claim 8, said body portion of said fuel injector bars operating as a heat shield to the fuel flowing therethrough to said injectors.

10. The fuel injection system of claim 1, said fuel injector bars being located in slots provided in said vanes of said dome inlet module.

11. A method of operating a gas turbine combustor, said combustor including a dome inlet module having a plurality of flow passages formed therein by a plurality of vanes positioned circumferentially therein, a combustion chamber, and at least one trapped vortex cavity formed within said combustion chamber by a liner downstream of said dome inlet module by an aft wall, a forward wall, and a third wall therebetween, said method comprising the following steps:

(a) injecting fuel into said trapped vortex cavity so as to create a rich primary combustion zone therein;

(b) injecting air into said trapped vortex cavity to create a trapped vortex of fuel and air therein;

(c) igniting said mixture of fuel and air in said trapped vortex cavity to form combustion gases;

(d) diluting said combustion gases with a flow of air through said flow passages of said dome inlet module; and (e) driving the overall mixture of fuel and air within said combustion chamber to a lean state.

12. The method of claim 11, wherein the equivalence ratio of the air/fuel mixture within said trapped vortex cavity during said igniting step is in a range of 1.0–2.0.

13. The method of claim 11, wherein the overall mixture of fuel and air in said combustion cavity has an equivalence ratio of less than 0.85 after said diluting step.

14. The method of claim 11, wherein said combustion gases experience equivalence ratios between 0.85 and 1.15 for a minimal time period during said diluting step.

* * * * *